US008595880B2

(12) United States Patent
Pichon et al.

(10) Patent No.: US 8,595,880 B2
(45) Date of Patent: Dec. 3, 2013

(54) ROLLING APPARATUS FOR CLEANING AN IMMERSED SURFACE WITH ORIENTATABLE DRIVING FLUX

(75) Inventors: Philippe Pichon, Villeneuve de Riviere (FR); Emmanuel Mastio, Fourquevaux (FR)

(73) Assignee: Zodiac Pool Care Europe (FR)

( * ) Notice: Subject to any disclaimer, the term of this patent is extended or adjusted under 35 U.S.C. 154(b) by 305 days.

(21) Appl. No.: 13/057,561

(22) PCT Filed: Aug. 3, 2009

(86) PCT No.: PCT/FR2009/051546

§ 371 (c)(1),
(2), (4) Date: Apr. 15, 2011

(87) PCT Pub. No.: WO2010/015774

PCT Pub. Date: Feb. 11, 2010

(65) Prior Publication Data

US 2011/0203060 A1 Aug. 25, 2011

(30) Foreign Application Priority Data

Aug. 4, 2008 (FR) ..... 08 04424

(51) Int. Cl.
*E04H 4/16* (2006.01)

(52) U.S. Cl.
USPC ..... 15/1.7

(58) Field of Classification Search
USPC ..... 15/1.7
See application file for complete search history.

(56) References Cited

U.S. PATENT DOCUMENTS

| | | | |
|---|---|---|---|
| 4,835,809 | A | 6/1989 | Roumagnac |
| 6,099,658 | A | 8/2000 | Porat et al. |
| 2,007,157 | A1 | 7/2007 | Roumagnac |

FOREIGN PATENT DOCUMENTS

| | | |
|---|---|---|
| EP | 1022411 | 7/2000 |
| FR | 2586054 | 2/1987 |
| FR | 2635068 | 2/1990 |
| FR | 2896005 | 7/2007 |

OTHER PUBLICATIONS

International Search Report dated Mar. 3, 2010 in Application No. PCT/FR2009/051546.
International Preliminary Report on Patentability dated Oct. 26, 2010 in Application No. PCT/FR2009/051546.

*Primary Examiner* — Shay Karls
(74) *Attorney, Agent, or Firm* — Dean W. Russell; Kilpatrick Townsend & Stockton LLP

(57) ABSTRACT

The invention relates to a rolling apparatus for cleaning an immersed surface comprising a hollow body; rolling members; a filtration chamber which is provided in the hollow body; a motorized pumping device configured for generating a flow of liquid between a liquid inlet (9) and a liquid outlet which are connected, wherein it comprises a directional flux guide (91) which is mounted for rotation on a liquid outlet (10) about an axis of rotation and which has a shape configured for orientating the current of liquid which is discharged via this propulsion outlet (10) through this flux guide (91) so that it creates, by means of reaction, in the region of an outlet of the flux guide, forces whose resultant has a non-zero drive component of the apparatus parallel with the immersed surface; an actuator for rotatably driving said flux guide (91); and a unit for controlling said actuator for rotatably driving said flux guide (91).

21 Claims, 7 Drawing Sheets

Figure 1:
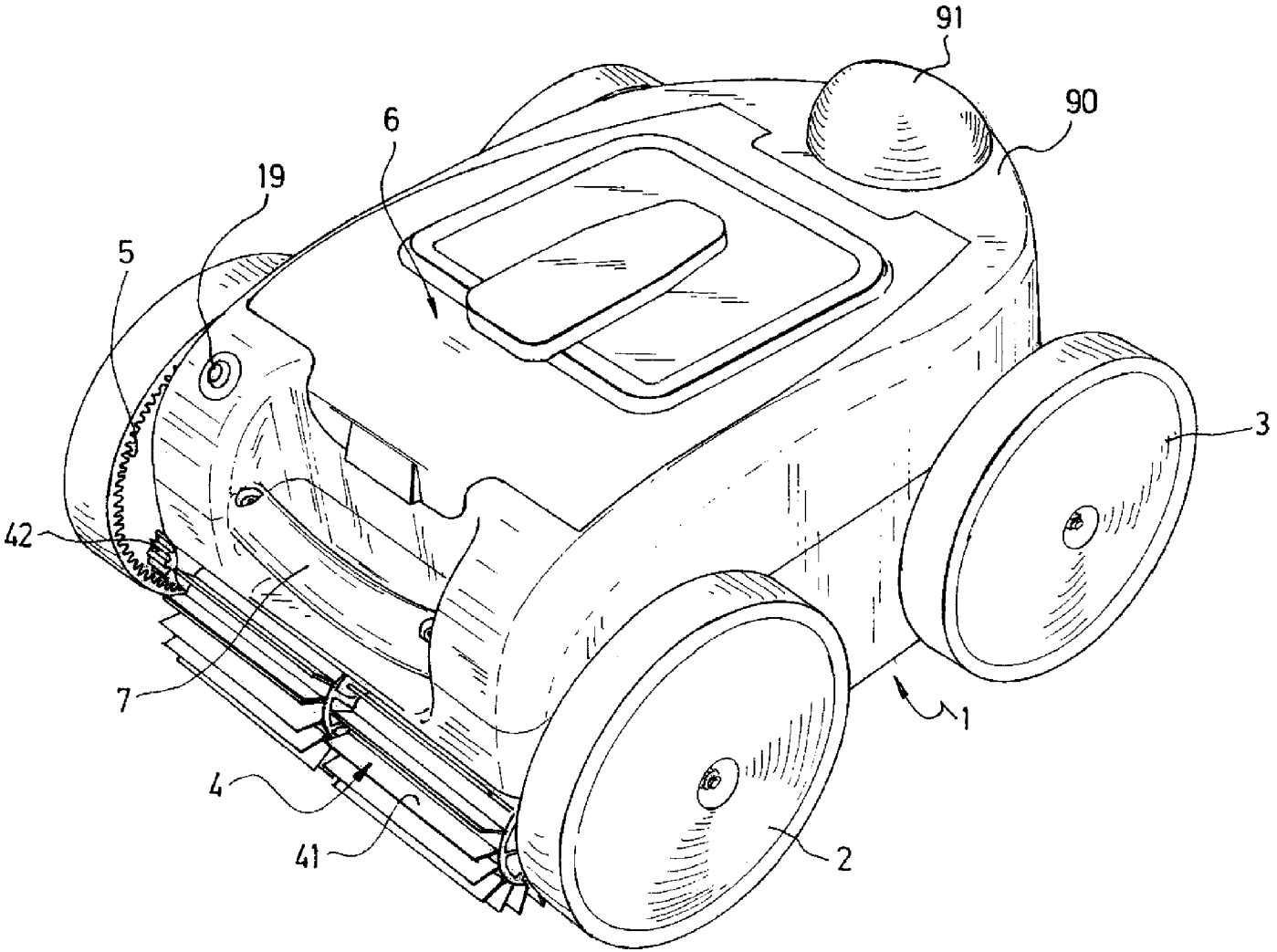

ROLLING APPARATUS FOR CLEANING AN IMMERSED SURFACE WITH ORIENTATABLE DRIVING FLUX

CROSS REFERENCE TO RELATED APPLICATIONS

This application is the U.S. national phase of International Application No. PCT/FR2009/051546 filed on Aug. 3, 2009 and published as International Publication No. WO 2010/015774 A2 on Feb. 11, 2010, which application claims priority to French Patent Application No. 0804424 filed on Aug. 4, 2008.

The invention relates to a rolling apparatus for cleaning an immersed surface having at least partially hydraulic driving, that is to say, an apparatus whose movement over the immersed surface results at least partially from a hydraulic reaction force to a hydraulic jet which is discharged from the cleaning apparatus, the orientation of the jet determining the movement orientation of the rolling apparatus over the immersed surface.

According to a first series of cleaning robots, the pressurized hydraulic jet is generated by a motorized pumping device which is arranged in the rolling apparatus and which is also intended to ensure a flow of liquid between a liquid inlet into the apparatus and a liquid outlet out of the apparatus through at least one filtering device.

According to another series of cleaning robots, the hydraulic jet is generated by a motorized pumping device which is external to the apparatus and which conveys pressurized liquid towards the apparatus.

FR 2 635 068 describes a robot configured for moving alternately in two substantially opposing directions. This robot comprises a pumping device arranged in the apparatus and configured for conveying drawn-in liquid towards an auto-rotating outlet pipe mounted at the center of the apparatus and via which this liquid is discharged. This auto-rotating pipe is configured for assuming two opposing non-aligned angular positions which are defined by stops which retract in contact with an obstacle, such as a swimming pool wall.

This robot has several disadvantages including the need to be subjected to a frontal impact with an obstacle in order to activate the change of orientation of the robot by retracting the retention stops of the auto-rotating pipe. Consequently, this robot does not allow a change of orientation in the center of the pool in the absence of an obstacle. Furthermore, such a robot has a low level of maneuverability and does not allow the time necessary for cleaning a pool to be optimized. There is consequently in particular a complete lack of energy saving.

EP 1 022 411 describes a rolling apparatus for cleaning an immersed surface comprising an integrated pumping motor and liquid outlets out of the apparatus. This apparatus is configured for directing at least part of a hydraulic flux pumped by the pumping motor to two opposing outlets of the apparatus. The hydraulic flux is used to ensure the forward/backward changes of direction of the apparatus on the immersed surface. This apparatus has a pipe which has two opposing outlets, one towards the rear and the other towards the front, and which extends parallel with the immersed surface in the region of an ascending channel for the drawn-in liquid. A movable valve which is arranged at the end of the ascending channel and which is operated by a programming device directs the liquid to one of the two opposing ends of the outlet pipe forming the two opposing outlets of the apparatus. Changing the position of the valve is possible only when the pumping device is stopped so that the apparatus can change driving direction under the action of the hydraulic flux only by stopping and restarting the pump. It should be noted in this regard that this document systematically assimilates the terms "orientation" and "direction", indicating that the apparatus can change orientation whilst in reality it can only change drive direction in the same longitudinal orientation (in the mathematical sense of the term). When the apparatus is driven in a backward direction, it adopts an inclined trajectory in accordance with a predetermined fixed angle relative to the longitudinal orientation thereof, which allows the immersed surface to be covered by transverse back-and-forth zig-zag movements.

Such an apparatus therefore particularly consumes a large amount of electrical energy since each change of orientation involves stopping the pumping motor and restarting the motor as soon as the valve has changed position. The demand for electrical current is at a maximum when the pump is restarted. Furthermore, this apparatus has a low level of maneuverability owing to its method for changing advance direction which does not allow it to be directed as desired on the immersed surface.

FR 2 896 005 also describes a rolling cleaning apparatus which comprises a propulsion pipe configured for directing a jet of liquid in an orientation opposite to the movement orientation of the robot. This pipe is mounted so as to rotate about an axis. The robot further comprises means for stopping the rotating pipe and means for controlling these stop means configured for being activated by means of a hydrodynamic force created by the movement of the robot so that, when the robot stops, the hydrodynamic force is cancelled, which releases the pipe from the means for stopping rotation and produces its rotation.

One of the disadvantages of such an apparatus is that the rotation of the pipe takes place only when the robot is in the stopped state. Consequently, the rotation of the pipe can take place only when the robot is in abutment against an obstacle, such as a wall of the swimming pool, or when the pump is stopped. Such an apparatus therefore has the same disadvantages as the apparatus described in EP 1 022 411, that is to say, low level of maneuverability and poorly optimized energy consumption.

The apparatus of the prior art which use part of the hydraulic output flux in order to drive the apparatus and to produce its changes of orientation have unsatisfactory energy balances. Furthermore, these apparatus require an interruption of the pumping operation and/or movement in order to allow a change in direction and/or orientation of the hydraulic output flux, which makes them difficult to handle and unresponsive.

Consequently, an object of the invention is to provide a rolling apparatus for cleaning an immersed surface which has better maneuverability than the apparatus of the prior art.

In particular, an object of the invention is to provide a rolling apparatus for cleaning an immersed surface whose movement and changes of orientation result at least partially from a hydraulic reaction force to a hydraulic jet which is discharged from the cleaning apparatus but without having to interrupt the pumping and/or drive motors.

An object of the invention is also to provide an apparatus whose energy consumption levels are rationalized, that is to say, whose energy consumption levels are adjusted as precisely as possible in accordance with the requirements of the apparatus.

An object of the invention is also to provide such an apparatus which can use, with performance levels which are the same as or even better than the apparatus of the prior art, a traction motor of lower cost.

The invention also relates to a rolling apparatus for cleaning an immersed surface whose performance/cost ratio is improved compared with that of prior apparatus. More specifically, an object of the invention is to provide an apparatus of this type whose cost can be substantially reduced with performance levels which are equivalent to or even better than those of known apparatus.

In the entire text, the term "orientation" is intended to be understood to be the orientation in the common sense of the term and not in the mathematical sense of the term. That is to say, the term "orientation" refers in this instance to the "orientated direction" in the mathematical sense of the term. Horizontal components having different and opposing orientations can therefore define the same straight line, each orientation defining an orientation (direction) on this straight line.

To this end, the invention relates to a rolling apparatus for cleaning an immersed surface comprising:

- a hollow body configured for being moved over the immersed surface at least in one direction of advance and in a main orientation of advance, called a longitudinal orientation,
- rolling members which have contact zones with the immersed surface defining a rolling plane of the hollow body over the immersed surface,
- a filtration chamber which is provided in the hollow body and which has:
  - at least one liquid inlet into the hollow body, located at the base of said hollow body,
- at least one liquid outlet out of the hollow body, located remotely from the base of said hollow body,
- at least one hydraulic circuit for circulation of liquid between at least one liquid inlet and at least one liquid outlet through at least one filtering device,
- at least one motorized pumping device which is at least partially interposed in a hydraulic circuit and configured for producing a flow of liquid between each liquid inlet and each liquid outlet which are connected by this hydraulic circuit, wherein it comprises:

- a directional flux guide which is mounted on a liquid outlet for rotation about a rotation axis, called a propulsion outlet, said flux guide having a shape configured to be able to orientate the current of liquid which is discharged via this propulsion outlet through that flux guide so that it creates, by means of reaction, level with an outlet of the flux guide, forces whose resultant, called a hydraulic reaction force, has a non-zero drive component of the apparatus, called a horizontal component, parallel with the rolling plane,
- an actuator for rotatably driving at least one movable deflection member of said flux guide about said rotation axis, said actuator being configured for orientating and retaining said movable deflection member in at least two different positions about said rotation axis corresponding to two horizontal components having different orientations, configured for moving the apparatus in at least two different orientations, at least one of which corresponds to the longitudinal orientation and the other is different both from the longitudinal orientation and the direction opposite the longitudinal orientation,
- a unit for controlling said actuator for rotatably driving said flux guide.

An apparatus according to the invention can change orientation via a movement of at least one movable deflection member of the directional flux guide. In particular, a movement of at least one movable deflection member of the directional flux guide produces a change in orientation of the horizontal component of the hydraulic reaction force which produces a change in trajectory of the apparatus which can thus turn and be directed on the immersed surface. In practice, each movable deflection member of the flux guide is held in a first position in order to ensure a movement of the apparatus in the main longitudinal orientation of advance. A movement—in particular a rotation—of at least one movable deflection member of the flux guide towards a second position corresponding to a second orientation different from the longitudinal orientation (and not to a simple reversal of direction in the same orientation) places the apparatus on a curved trajectory. The apparatus follows this curved trajectory for as long as said movable deflection member of the flux guide is held in this second position. A return of said movable deflection member of the flux guide to the first position corresponding to the longitudinal orientation allows the apparatus to resume rectilinear movement over the immersed surface in accordance with this main longitudinal orientation of advance. The movement of each movable deflection member of the flux guide therefore allows the trajectory of the apparatus to be orientated on the immersed surface, that is to say, allows it to be directed by turning it one direction or the other.

Furthermore, this change in orientation does not require an interruption of the pumping device so that an apparatus according to the invention has improved maneuverability compared with apparatus of the prior art.

Furthermore, each movable deflection member of the flux guide is moved—in particular in terms of rotation—by an actuator which is controlled by a control unit. Consequently, an apparatus according to the invention can change orientation at any point of a pool to be cleaned, which allows cleaning programs to be implemented which are specific to each type of pool to be cleaned. In particular, a pool which has an atypical shape with corners can be readily cleaned by an apparatus according to the invention since it allows any type of change in orientation.

According to the invention, the driving actuator is configured for orientating and retaining at least one movable deflection member of the flux guide in at least two different positions about the rotation axis which correspond to two horizontal components having different orientations.

According to a first production variant of the invention, said flux guide is a tubular directional flux guide which is mounted on the propulsion outlet so as to rotate about a rotation axis, and this tubular flux guide has at least one deflection wall which is not perpendicular to the opening plane of said propulsion outlet on which it is mounted so that the current of liquid which is discharged via this propulsion outlet can be deflected by this deflection wall. Said actuator is also configured for rotatably driving said flux guide as a whole about said rotation axis. In this variant, said movable deflection member is therefore formed by the tubular flux guide itself as a whole.

According to a second production variant which can be combined with the preceding variant, said flux guide comprises, as a movable deflection member, at least one deflection fin which is mounted for movement inside the flux guide so as to extend:

- in a first orientation corresponding to a first orientation, called a nominal orientation, of the flux originating from said propulsion outlet for a first flow value, called a nominal flow, of the flux emitted by the motorized pumping device,
- in at least a second orientation corresponding to a second orientation, different from the nominal orientation, of the flux originating from said propulsion outlet for at least a second flow value of the flux emitted by the motorized pumping device, different from the nominal flow.

Advantageously, said first orientation corresponds to the longitudinal orientation towards the rear of the apparatus, so that it is driven in the main longitudinal orientation of advance in a forward direction by the hydraulic component of the flux orientated in this first orientation.

In a particularly advantageous embodiment of this second variant, said deflection fin is articulated about a rotation axis inside the flux guide and is resiliently returned into a first position which is not in alignment with the orientation of the flux in the flux guide, the assembly being configured so that the orientation of the fin relative to the articulation axis thereof is dependent on the flow value of the flux in the flux guide. When the pumping device emits the flux with the nominal flow, said fin is aligned with the general orientation of the flux guide and the apparatus is driven in its main orientation of advance. When the flow of the flux in the flux guide is different from the nominal flow, the hydrodynamic forces on the fin are modified so that it is no longer in alignment with the general orientation of the flux guide. For example, when the flux is less than the nominal flow, the fin is resiliently returned close to the internal wall of the flux guide and, when the flux is greater than the nominal flow, the fin is moved beyond the alignment position thereof with the orientation of the flux guide, counter to its resilient return (the internal wall of the flux guide being able to be provided with a fixed deflection vane opposite the movable deflection fin in order to bring about this additional pivoting of the deflection fin counter to the resilient return means if the flux increases beyond the nominal flow). In this second variant, said drive actuator is formed by the combination of the pumping device and the resilient return means of the deflection fin.

Advantageously and according to the invention, the actuator for rotatably driving the flux guide is configured for orientating and retaining at least one movable deflection member of the flux guide in at least three different positions about said rotation axis corresponding to three horizontal components having different orientations.

An apparatus may thus have three preferred trajectories, each trajectory corresponding to an orientation of the horizontal component of the hydraulic reaction force defined by the position of each movable deflection member of the flux guide—in particular the flux guide about its rotation axis—. Since the three orientations are different, at least two trajectories intersect so that the apparatus can be moved in accordance with any trajectory defined as a sum of movement along each of the preferred trajectories.

Advantageously and according to the invention, the actuator is configured for orientating and retaining each movable deflection member of the flux guide in any position—in particular for orientating and retaining said flux guide in any position—about the rotation axis—so that the corresponding horizontal component can have any orientation—in particular about the rotation axis—.

According to an advantageous embodiment, the flux guide can be moved and held in position at any point about the rotation axis. The flux guide may be subjected to a rotation of 360° about its rotation axis so that the outlet flux can be orientated over 360° about the rotation axis of the flux guide. An apparatus according to the invention can therefore pivot over 360° at any point of the immersed surface in order to reach any other point of the immersed surface in a straight line (in the case of a convex pool in the mathematical sense of the term). An apparatus according to this advantageous embodiment is therefore particularly maneuverable. This maneuverability allows an apparatus according to the invention to clean surfaces which have irregular shapes such as surfaces of swimming pools which imitate lagoons, and generally swimming pool surfaces with free shapes. Furthermore, an apparatus according to this advantageous embodiment is particularly suitable for complex cleaning programs which require frequent changes of orientation, in particular over short distances. An apparatus according to the invention is also particularly suitable for cleaning swimming pools which have simple shapes, in particular rectangular swimming pools, allowing methodical and optimized movement of the apparatus over the surface of the swimming pool. The movement of the flux guide can be continuous about the rotation axis thereof so that the output flux can also be orientated continuously over 360° about the rotation axis of the flux guide.

In order to achieve the maximum effects of the hydraulic reaction force, advantageously and according to the invention, said flux guide protrudes relative to the upper walls of the apparatus opposite the rolling plane so that the current of liquid which is discharged from the flux guide can disperse freely without encountering members of the apparatus.

The shape of the flux guide and its arrangement at the propulsion outlet may be of any type configured to allow the orientation of the current of liquid which is discharged via this propulsion outlet through this flux guide so that it creates a hydraulic reaction force which has a non-zero horizontal component.

Advantageously and according to the invention, the flux guide has at least one wall which is not perpendicular to the opening plane of said propulsion outlet, on which it is mounted so that the liquid current which is discharged via this propulsion outlet can be redirected by that wall. Furthermore, since the flux guide can pivot about its axis of rotation, this wall which is not perpendicular to the opening plane of the propulsion outlet can also pivot about the axis of rotation of the flux guide, which allows redirection of the hydraulic outlet flux in all orientations, the orientation of the redirection depending on the position of this wall.

Advantageously and according to the invention, the flux guide is bent. According to one embodiment, the flux guide has a lower portion which extends in the axis of the opening plane of the propulsion outlet and an upper portion which extends in accordance with an axis which is inclined relative to the axis of the opening plane of the propulsion outlet, these two portions being connected by a bent intermediate portion. The propulsion outlet can, for example, have a circular opening and the lower portion of the flux guide can have a cylindrical shape with a circular cross-section having the same dimensions as the circular opening of the propulsion outlet and having the same axis of symmetry.

According to the invention, the propulsion outlet may be arranged at one of the longitudinal ends of the apparatus or anywhere between those ends, in particular at the center of the upper walls of the apparatus. Nevertheless, advantageously and according to the invention, the propulsion outlet on which the flux guide is mounted is offset backwards in the longitudinal orientation of each liquid inlet with which it is in communication via a hydraulic circuit.

Advantageously and according to the invention, the axis of rotation of the flux guide forms an angle between 30° and 150° with the rolling plane.

According to an advantageous embodiment of the invention, the flux guide has a shape configured so that the liquid current which is discharged via said rear outlet via this flux guide can further create by reaction a hydraulic reaction force which has a non-zero vertical component of the apparatus in a downward direction. This non-zero vertical component of the hydraulic reaction force seeks to keep the apparatus pressed against the immersed surface.

According to an advantageous embodiment of the invention, the apparatus comprises at least one electric drive motor of at least one rolling member, called a drive rolling member, so as to form an additional drive device which is capable, via this/these drive rolling member(s), of moving the hollow body over the immersed surface.

The electric drive motor can be used constantly in a concomitant manner with the hydraulic driving or only as an additional drive means specific to some specific situations. For example, each electric drive motor of the drive rolling members may be started only when the apparatus encounters a vertical wall in order to assist it to climb this wall. In particular, according to an advantageous embodiment, a drive rolling member is a wheel which is arranged on a lateral side of the apparatus which comprises a ring having an internal tooth arrangement configured to engage with a pinion, called a wheel pinion, which is caused to rotate by an electric drive motor. The wheel pinion may or may not be integral with the drive axle of the electric motor. The apparatus preferably comprises a disengagement mechanism so that the driving of the drive wheel by the electric motor is produced only when the apparatus encounters a wall or any other specific situation. This disengagement mechanism is advantageously controlled by a control unit.

An apparatus which is provided with a rear liquid outlet and which is associated with wheels which may be motorized at the control of a control unit—in particular front wheels—may have a number of programs specific to a number of situations which are commonly encountered during the normal operation of a cleaning apparatus in a pool, such as a swimming pool. In particular, when such an apparatus encounters a vertical wall at the end of a trajectory over a horizontal or substantially horizontal wall, the front wheels of the apparatus are pressed against this vertical wall owing to the horizontal component of the hydraulic reaction force so that the front of the apparatus is raised along the vertical wall. In order to facilitate this raising action, the additional electric drive motors can be engaged in the wheels. Consequently, the drive wheels which are associated with the hydraulic flux allow the apparatus to ascend along the vertical wall.

An apparatus according to the invention also allows control in a particularly effective manner when passing stair nosings, that is to say, related junction edges between a vertical wall and a horizontal wall. In the same manner as for an encounter with a vertical wall, the horizontal component of the hydraulic jet ensures the positioning of the drive rolling members against the walls in such a manner that the apparatus is raised against the vertical wall. When the drive rolling members are raised from the vertical wall and therefore no longer allow the apparatus to be driven, the hydraulic driving provides the power necessary to allow pivoting of the apparatus in the direction for returning the rolling members thereof into contact with the horizontal wall forming the stair nosing.

Advantageously and according to the invention, an apparatus comprises a front axle which carries at least one drive rolling member which is mounted relative to the hollow body so as to rotate about a transverse axis.

Advantageously and according to the invention, the front axle carries two drive rolling members which are mounted at each of the ends of the axle, respectively, each drive rolling member being rotatably driven by an electric drive motor.

The electric motors of the apparatus can be supplied with electrical power via an electrical power supply external to the apparatus by means of an electrical cable or via an electrical power supply internal to the apparatus, such as electrical energy accumulators.

According to an advantageous variant of the invention, the electric motors are supplied via a battery on-board the apparatus.

Such a battery may supply both an electric drive motor and the actuator for rotatably driving the flux guide of an apparatus according to the invention.

Advantageously and according to the invention, the pumping device comprises an electric pumping motor which comprises a rotating drive shaft connected to an axial pumping propeller which is interposed in a hydraulic circuit and whose axis of rotation is inclined relative to the longitudinal orientation and is different from the axis of rotation of said flux guide.

Advantageously and according to the invention, the control unit can be programmed so as to allow parameterizing of the control of the actuator for moving each movable deflection member—in particular for rotatably driving the flux guide—that is specific to each surface to be cleaned by the apparatus.

The invention also relates to a rolling apparatus for cleaning an immersed surface characterized in combination by all or some of the features set out above or below.

Figure 2:
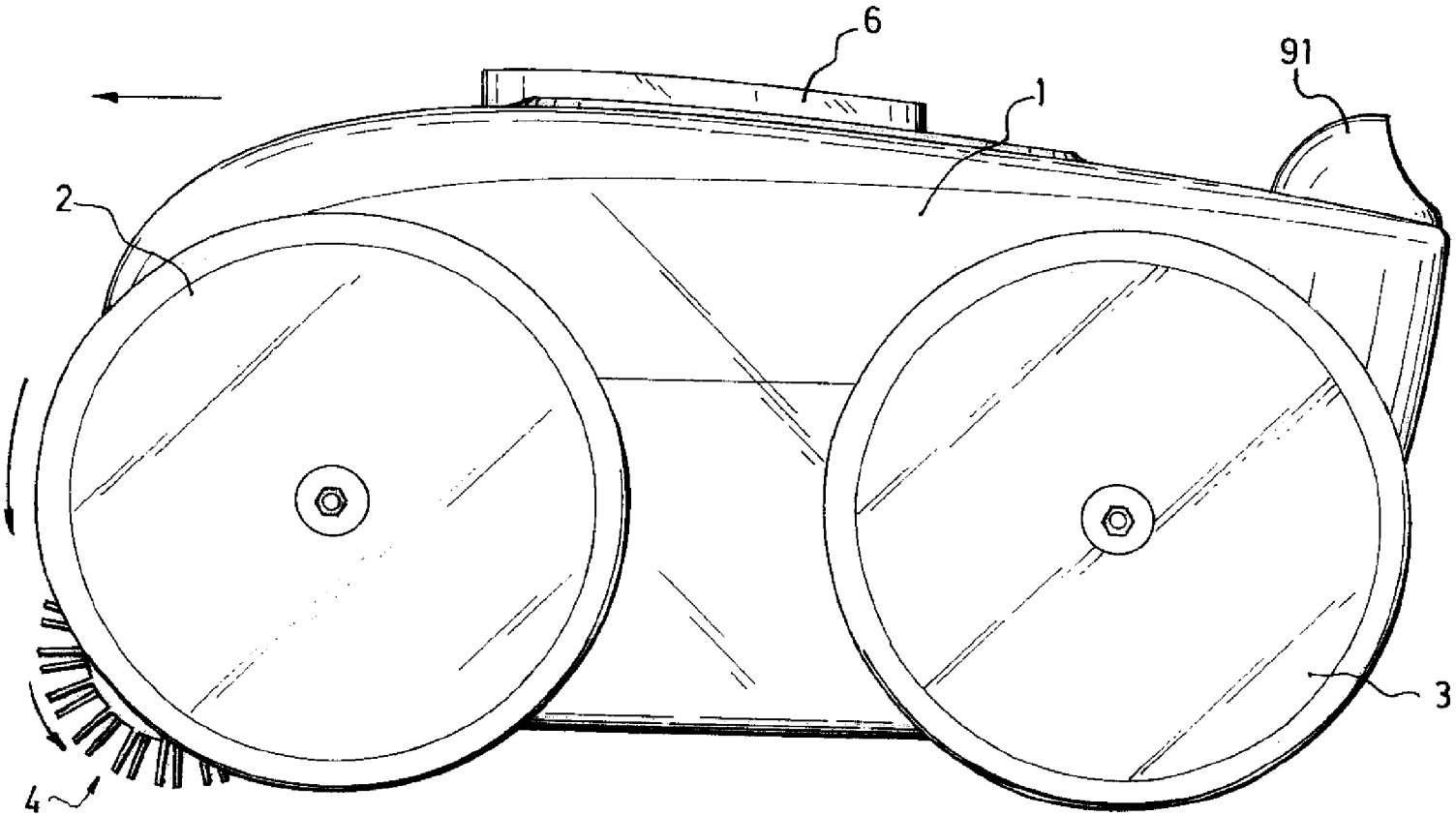
Figure 3:
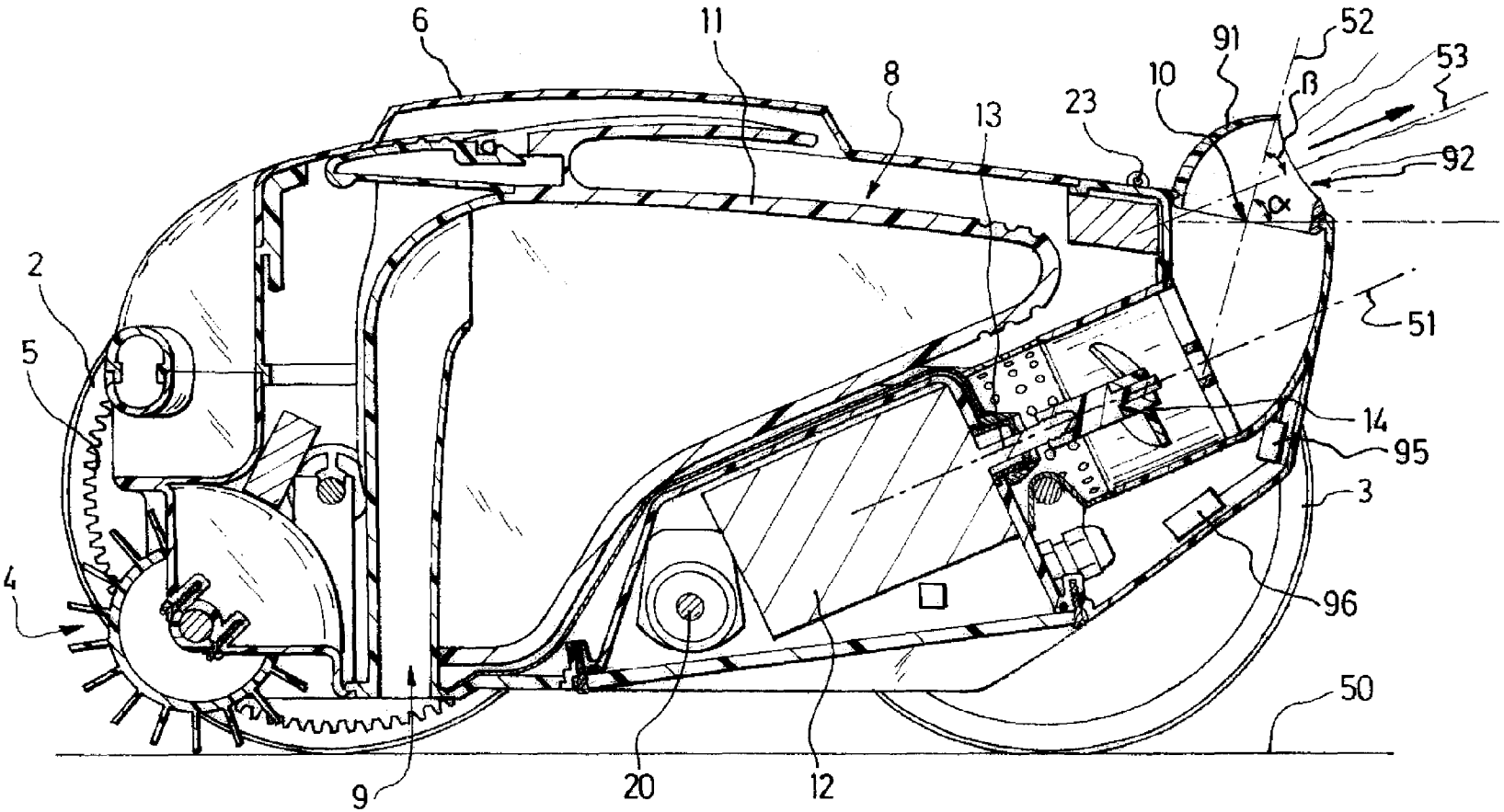
Figure 4:
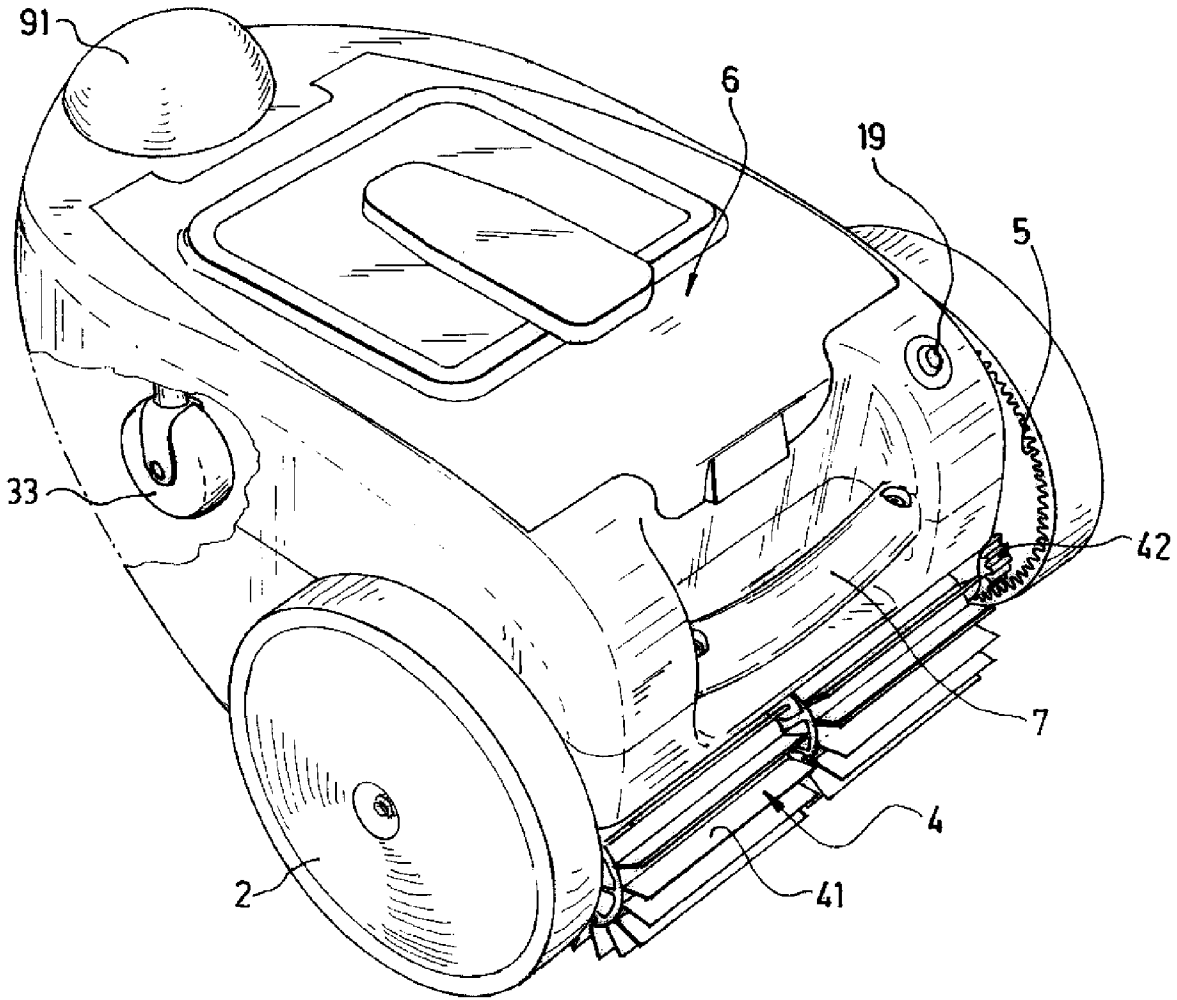
Figure 5:
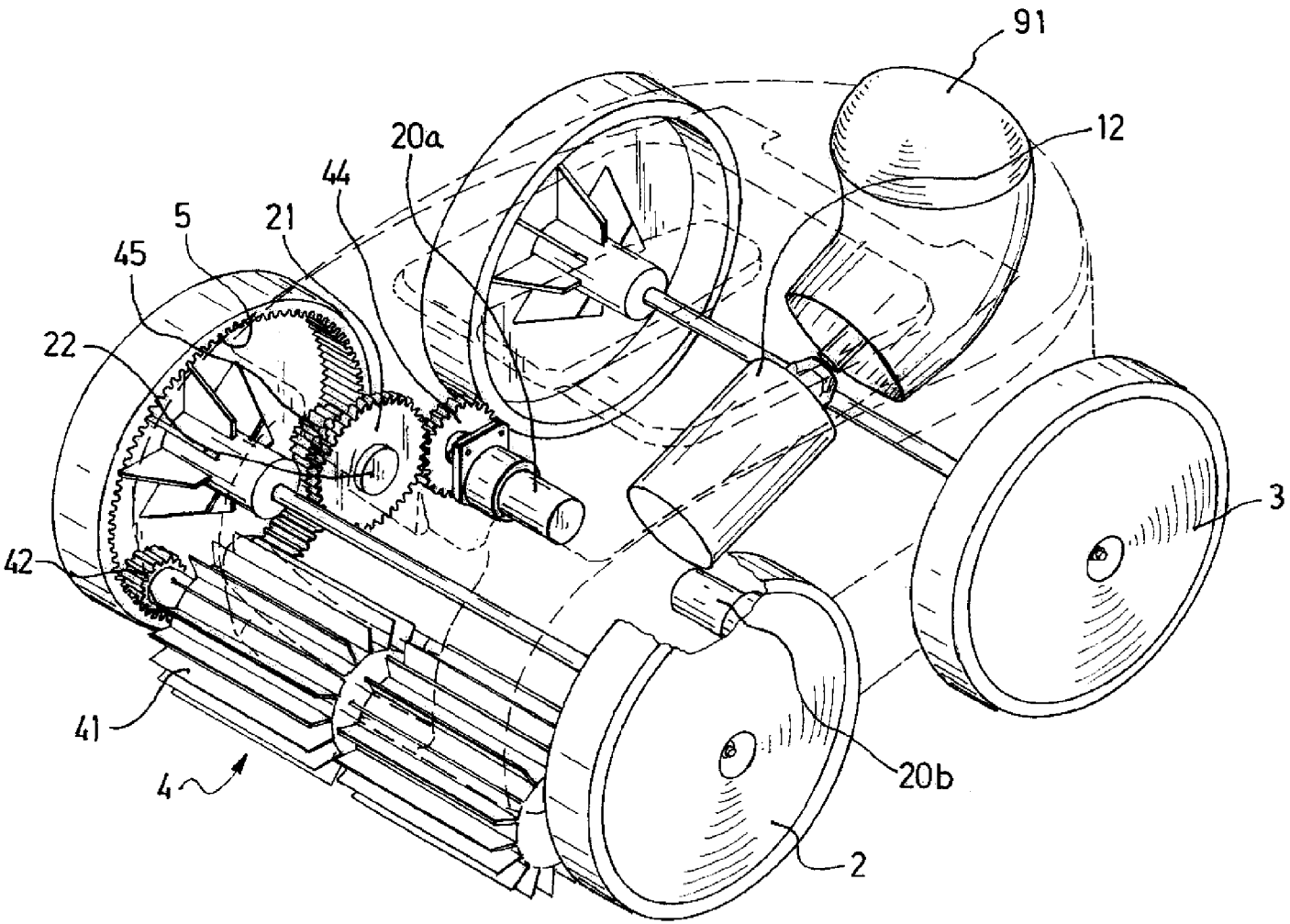
Figure 6:
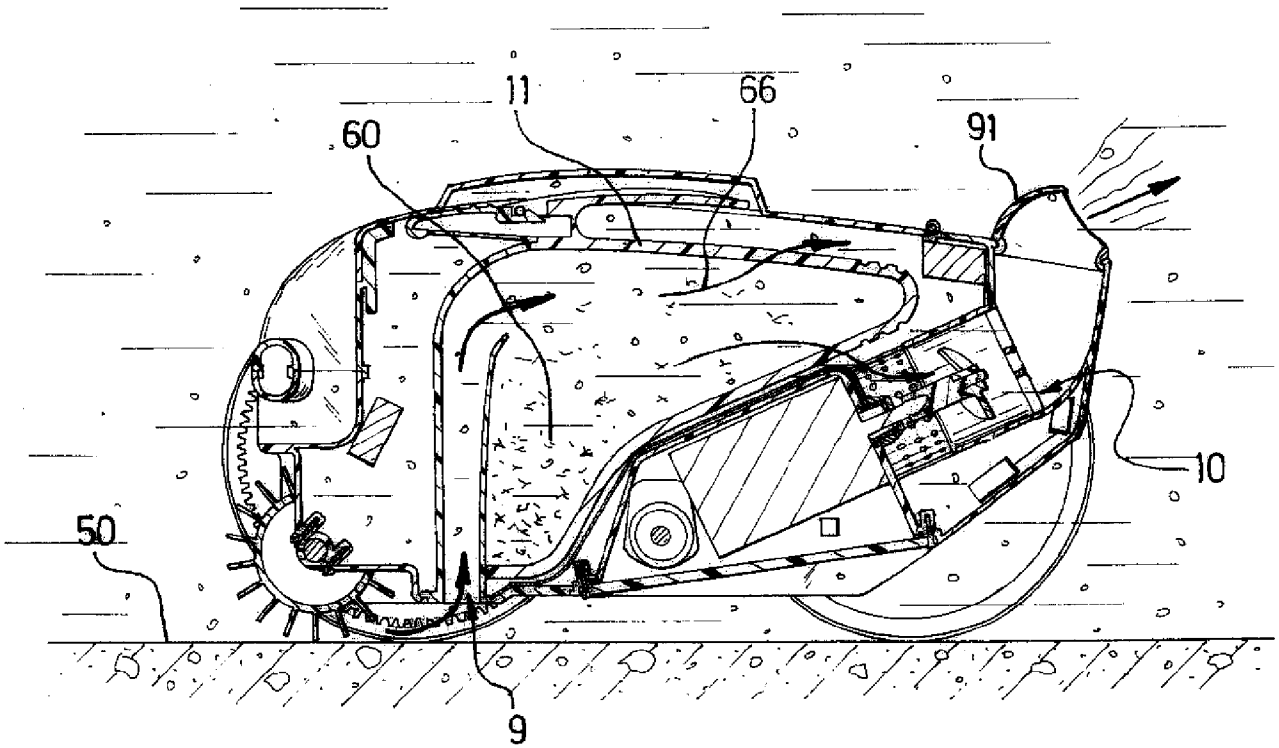
Figure 7:
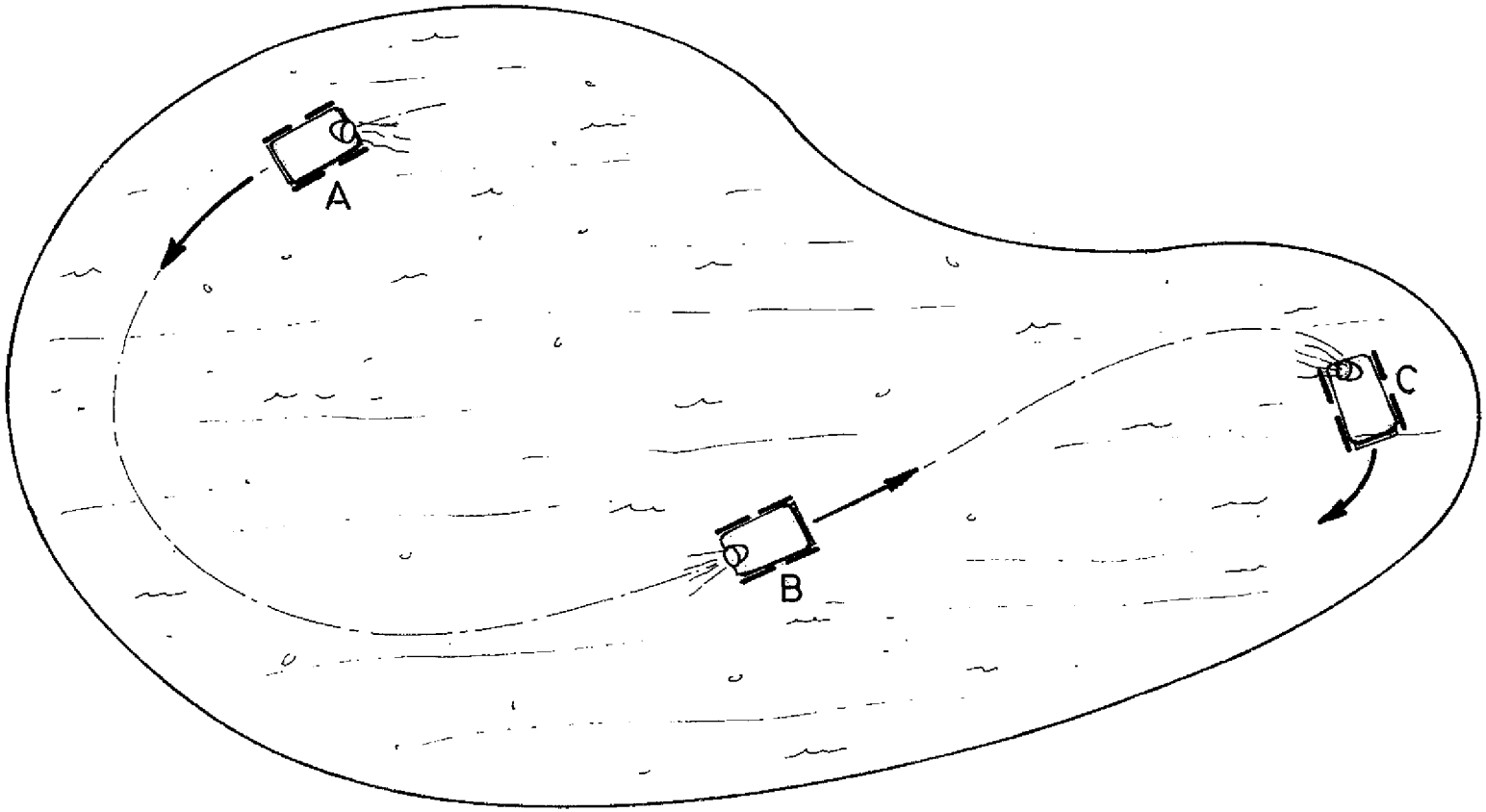

Other objects, features and advantages of the invention will be apparent from a reading of the following description which is given purely by way of non-limiting example and with reference to the appended Figures, in which:

FIG. 1 is a schematic perspective view of an apparatus according to one embodiment of the invention, FIG. 2 is a schematic profile view of the apparatus of FIG. 1, FIG. 3 is a schematic sectioned view in a vertical longitudinal plane of the apparatus of FIG. 1, FIG. 4 is a schematic perspective view of an apparatus according to another embodiment of the invention, FIG. 5 is a schematic perspective view of an additional mechanism for driving the apparatus over the immersed surface, FIG. 6 is a schematic top view of a possible trajectory followed by an apparatus according to the invention, FIG. 7 is a schematic sectioned view of an apparatus according to the invention during movement over an immersed surface.

In the Figures, the scales and proportions have not been strictly complied with for the purposes of illustration and clarity.

In the entire detailed description which follows with reference to the Figures, unless otherwise indicated, each component of the cleaning apparatus is described as it is arranged when the apparatus is moving normally over a horizontal immersed surface in accordance with a preferred direction of advance.

An apparatus according to the invention comprises a hollow body 1 and rolling members for guiding the hollow body 1 over an immersed surface in at least one preferred direction of advance and in accordance with a main orientation of advance, called a longitudinal orientation, parallel with the immersed surface.

This hollow body 1 is formed mainly by a concave housing which delimits a main chamber. This concave housing is, for example, constructed by molding or rotational molding. This housing is preferably constructed from a thermoplastic material, such as polyethylene, polypropylene, ABS, PMMA or any equivalent material.

This hollow body 1 has a central chamber configured for receiving a filtration chamber. According to the embodiment of FIG. 1, this central chamber is delimited by a lower wall which extends in a substantially horizontal plane; by lateral walls which generally extend in vertical planes; by a front wall which generally extends in a vertical plane, orthogonal relative to the planes of the vertical lateral walls; and by a rear wall which generally extends in a vertical plane orthogonal relative to the planes of the vertical lateral walls. Furthermore, the hollow body 1 comprises an upper rear wall 90 which adjoins the rear wall and partially adjoins the lateral walls.

The lower wall has an opening which extends transversely in the region of the front wall so that liquid can return to the central chamber via this lower transverse opening.

The upper rear wall 90 comprises a circular opening. This opening provided in the upper rear wall of the housing is longitudinally offset from the lower transverse opening provided in the lower wall. This opening is vertically offset from the lower transverse opening.

As illustrated in particular in FIG. 3, this hollow body 1 comprises a filtration chamber 8 which has a liquid inlet 9 located at the base of the hollow body 1, that is to say, in the lower portion of the apparatus, a liquid outlet called a propulsion outlet 10 which is arranged opposite the base of the body 1, and a hydraulic circuit configured for providing a circulation of liquid between the liquid inlet 9 and the liquid outlet through a filtering device 11.

The transverse opening which is provided in the lower wall of the housing forms the liquid inlet 9 of the apparatus and the opening which is provided in the upper rear wall 90 of the apparatus forms the propulsion outlet 10 of the apparatus.

The filtering device 11 is arranged between the liquid inlet 9 and the propulsion outlet 10. This filtering device 11 may be of any known type. For example, the filtering device 11 comprises a rigid frame and a filtering material carried by this rigid frame. Such a filtering device 11 is therefore self-supporting and can be readily handled by a user.

The apparatus also comprises a flap 6 for access to this filtering device 11. This access flap 6 forms an upper wall of the hollow body 1 which, once closed, extends the upper rear wall 90 of the hollow body 1. In the embodiment illustrated, this flap 6 is provided on the upper portion of the apparatus so that a person using the apparatus can readily open the flap 6 and remove the filtering device 11. The access flap 6 is articulated to the body 1 of the apparatus by means of hinges 23 which are provided at the rear of the apparatus.

An apparatus according to the invention further comprises a directional flux guide 91 which is rotatably mounted on the propulsion outlet 10. The flux guide 91 has a shape configured to be able to orientate the liquid current which is discharged via this propulsion outlet 10, then via this flux guide so that it creates by reaction, level with the outlet 92 of the flux guide, forces whose resultant, called a hydraulic reaction force, has a non-zero drive component of the apparatus parallel with the rolling plane 50, called a horizontal component. The liquid is discharged from the apparatus through the outlet 92 of the flux guide after leaving the hollow body 1 via the propulsion outlet 10 and being redirected by the flux guide 91 so that it has a non-zero horizontal component. The flux guide 91 is mounted for rotation on the propulsion outlet 10 so that the axis 52 of rotation of the flux guide 91 is aligned with the axis normal to the opening plane of the propulsion outlet 10. In FIG. 3, therefore, the axis 52 defines both the axis normal to the opening plane of the propulsion outlet 10 and the axis of rotation of the flux guide 91.

According to the embodiment of the Figures and as illustrated in particular in FIG. 3, the flux guide 91 is bent. The angle β formed by the bend, that is to say, the angle between the axis 52 normal to the opening plane of the propulsion outlet 10 and the axis 53 normal to the opening plane of the outlet 92 of the flux guide, is preferably between 30° and 60°. This angle β particularly depends on the angle α which is formed between the axis 52 normal to the opening plane of the propulsion outlet 10 and the rolling plane 50, given that the flux guide 91 must have a shape configured so that the liquid which is discharged from the flux guide 91 has a non-zero horizontal component. This rolling plane 50 is horizontal when the immersed surface is planar and horizontal.

The liquid is discharged from the apparatus via the flux guide 91 at a speed V which is orientated in accordance with the axis 53 which is normal to the opening plane of the outlet 92 of the flux guide 91 and which has a horizontal component which produces by reaction a hydraulic reaction force Fe which has a horizontal drive component Fel which is orientated in the opposite direction and which moves the apparatus over the immersed surface.

An apparatus according to the invention further comprises an actuator 95 for rotatably driving the flux guide 91 about the axis 52 of rotation thereof. According to a preferred embodiment, this actuator is configured for orientating and maintaining the flux guide 91 in any position about the axis 52 of rotation so that the horizontal component can have any orientation about the axis 52 of rotation and therefore drive the apparatus in any direction. This actuator 95 is an electrical actuator of known type and is not described in detail here.

This actuator 95 is, according to the invention, controlled by a control unit 96 configured for controlling the rotation of the flux guide 91 about the axis 52 of rotation thereof. Such a control unit may have specific control programs which are prerecorded in a memory associated with the control unit 96 and/or receive signals from a transmitter which is external to the apparatus, such as a remote control activated by a user who is beside the pool to be cleaned, or an equivalent means. The control unit 96 can also receive information from devices for detecting at least one instruction signal which is representative of at least one predetermined state of the apparatus. This device for detecting instruction signals comprises, for example, front or rear wall sensors so that their being activated reveals that the apparatus is in a front or rear state of blockage against a wall. The control unit 96 may then, in accordance with a prerecorded program, control the pivoting of the flux guide 91 about the axis 52 of rotation thereof through a predetermined angle in order to allow the apparatus to move away from the wall detected.

A front wall sensor or rear wall sensor may be of any known type. For example, such a sensor may be a contact type sensor.

The control unit 96 can, according to a specific embodiment, control the power of the electric motor 12 of the pumping device and/or the power of the electric drive motors 20*a*, 20*b* of the front drive wheels 2 in the case of an apparatus comprising such an additional driving device.

In the embodiment of FIG. 1 in particular, the rolling members for guiding the apparatus comprise a front axle comprising front wheels 2, one at each side, and a rear axle comprising rear wheels 3, one at each side.

According to another embodiment illustrated in FIG. 4, the rolling members for guiding the apparatus comprise a front axle which comprises front wheels 2, one at each side, and a small rear wheel 33. This small rear wheel 33 is preferably vertically aligned with the flux guide 91.

Furthermore, preferably and as illustrated in the Figures, the apparatus comprises brushes 4 which are arranged at the front of the apparatus. These brushes 4 are intended to brush the immersed surface and to move the pieces of debris which are brushed towards the rear of the apparatus in the direction of the liquid inlet 9 which is provided below the apparatus.

These brushes 4 may be of any type. According to one embodiment of the invention, the apparatus comprises two coaxial front brushes 4. Each brush 4 is configured for being rotated about an axis which extends in an orientation called a transverse orientation and perpendicular relative to the longitudinal orientation. Each brush 4 comprises a plurality of fins 41 which extend radially from a brush shaft which forms the rotation axis of the brush 4. The fins 41 are, for example, of rubber or a strong plastics material.

According to a preferred embodiment of the invention, the apparatus comprises an additional device for driving the apparatus over the immersed surface. To this end, the apparatus comprises front drive wheels 2 and the driving device comprises, for example, an electric motor 20 for driving these front drive wheels 2. Preferably and as illustrated in FIG. 5, the apparatus comprises two drive motors 20*a*, 20*b*, one at each side, respectively, for independently driving each of the two front wheels 2. To this end and according to one embodiment, each electric motor 20*a*, 20*b* comprises a drive shaft comprising a drive pinion 44. This drive pinion 44 is engaged with an intermediate pinion 21 which is integral with an intermediate shaft 22. This intermediate shaft 22 comprises, at the end of the shaft opposite the intermediate pinion 21, a wheel pinion 45 which is engaged with a peripheral ring 5 which has an internal tooth arrangement integral with a front wheel 2. The wheel pinion 45, the intermediate pinion 21, the intermediate shaft 22 and each drive pinion 44 form a transmission configured for transmitting to the wheels 2 a torque allowing the apparatus to move over the immersed surface. The structure of this transmission is such that each electric motor 20*a*, 20*b* drives a drive shaft in rotation in a direction opposite to the direction of rotation of the wheels 2.

According to a preferred embodiment, the internally toothed peripheral ring 5 of each front drive wheel 2 cooperates with a brush pinion 42 which is fixed to an end of the shaft of a brush 4 so that rotation of the wheel 2 produces, by means of the internally toothed ring 5 and the brush pinion 42, rotation of the shaft of the brush 4 and therefore rotation of the brush 4.

The front wheels 2 preferably have a diameter of between 100 mm and 500 mm, in particular between 150 mm and 250 mm. According to the embodiment of the Figures, the front wheels 2 have a diameter in the order of 200 mm. In this manner, these front wheels 2 facilitate the passing of obstacles and have improved traction. Advantageously, their peripheral tread is formed by or covered with an anti-skid material.

The front wheels 2 and the brushes 4 constitute front drive rolling members 2, 4 which protrude forwards relative to the other constituent elements of the apparatus, in particular the hollow body, in order to form the extreme front portion of the apparatus and first come into contact with an obstacle which is encountered during the forward movement, for example a vertical wall.

An apparatus according to the invention comprises a motorized liquid pumping device which comprises an electric pumping motor 12 which has a rotating drive shaft 13 which is coupled to an axial pumping propeller 14 which is rotated by the motor 12 about an axis 51. The propeller 14 is interposed in the hydraulic circuit in order to generate therein a flow of liquid between the liquid inlet 9 and the propulsion outlet 10. The propulsion outlet 10 is directly opposite the pumping propeller so that the liquid flows out of the propulsion outlet 10 in accordance with an orientation which corresponds to the liquid flow generated by the pumping propeller, this flow having a speed which is orientated in accordance with the axis 51 of rotation of the propeller 14. This liquid is subsequently redirected by the flux guide 91.

FIG. 7 illustrates an immersed surface and an apparatus according to an embodiment of the invention comprising a flux guide which can be orientated over 360°. In position A, the apparatus enters a bend to its left by the flux guide being pivoted towards the inner side of the desired bend so that the hydraulic reaction force can cause the apparatus to pivot. The position of the flux guide may be maintained in the same orientation for the entire bend or may be pivoted further with respect to the longitudinal orientation in accordance with the desired curve of the bend. In position B, the flux guide is orientated in the longitudinal orientation so that the horizontal component of the hydraulic reaction force extends longitudinally towards the rear of the apparatus, which results in the apparatus moving in accordance with a straight rectilinear line. In position C, the flux guide is pivoted so that the apparatus can enter a bend to the right.

An apparatus according to the invention can thus be controlled in accordance with any specific program so that it has a high level of maneuverability which not only allows the cleaning of the immersed surfaces to be improved but also allows the trajectories to be optimized, and therefore the necessary resources in terms of electrical energy to be reduced.

The invention may have a number of production variants compared with the preferred embodiment illustrated in the Figures and described above. In particular, it is possible to make provision for the mounting of at least one deflection fin which is articulated about a transverse axis inside the flux guide 91, this fin being resiliently returned, for example, by a traction spring interposed between the fin and the internal wall of the flux guide 91. At least one deflection vane can be mounted so as to be fixed inside the internal wall of the flux guide 91 opposite the fin and opposite the traction spring. In this manner, the angular position of the deflection fin in the flux guide 91 is dependent on the flow value of the flux provided by the pumping device, which is itself dependent on the rotation speed of the pump 12. It is therefore possible to make provision that, for a nominal flow value of the flux, the deflection fin is aligned with the nominal orientation 53 of the flux guide 91, and that for a flux value less than the nominal flow value, the deflection fin is returned by the traction spring towards the internal wall of the flux guide 91, generating a horizontal directional component which rotatably drives the apparatus in one direction and, for a flux value greater than the nominal flow value, the deflection fin is driven under the action of the fixed deflection vane, beyond the nominal alignment position counter to the traction spring in order to generate a horizontal directional component which drives the apparatus in another rotation direction. In this production variant, which can be combined with the preceding variant, the actuator is constituted by the pump itself and the traction spring. It is thus possible to provide an apparatus which contains only one motor, or more precisely in which it is not necessary to provide a specific motor to produce the actuator which allows the apparatus to be directed.

Other production variants are possible.

The invention claimed is:

1. Rolling apparatus for cleaning an immersed surface comprising:

a body configured so as to be movable over the immersed surface at least in one direction of advance and in a main orientation of advance, called a longitudinal orientation, rolling members which have contact zones with the immersed surface defining a rolling plane of the body over the immersed surface, a filtration chamber which is provided in the hollow body and which has:

at least one liquid inlet into the body, at least one liquid outlet out of the body, at least one hydraulic circuit for circulation of liquid between at least one liquid inlet and at least one liquid outlet through at least one filtering device, at least one motorized pumping device which is at least partially interposed in a hydraulic circuit and configured for producing a flow of liquid between each liquid inlet and each liquid outlet connected by said hydraulic circuit, wherein it comprises:

a flux guide which is mounted on a liquid outlet, called a propulsion outlet, said flux guide comprising at least one movable deflection member and having a shape arranged for orientating a current of liquid which is discharged via said propulsion outlet through said flux guide so as to create, by means of reaction, at an outlet of the flux guide, forces whose resultant, called a hydraulic reaction force, has a non-zero drive component of the apparatus, called a horizontal component, parallel with said rolling plane, an actuator for driving said at least one movable deflection member of said flux guide, said actuator being configured for orientating and retaining said at least one movable deflection member in at least two different positions corresponding to two horizontal components having different orientations, configured for driving the apparatus in at least two different orientations, at least one of which corresponds to the longitudinal orientation and the other is different both from the longitudinal orientation and the direction opposite the longitudinal orientation, a unit for automatically controlling said actuator.

2. An apparatus as claimed in claim 1, wherein said flux guide is a tubular directional flux guide which is rotatably mounted about an axis of rotation on said propulsion outlet, wherein said flux guide has at least one deflection wall which is not perpendicular to an opening plane of said propulsion outlet on which it is mounted so that said current of liquid which is discharged via said propulsion outlet can be redirected by said deflection wall and wherein said actuator is arranged for rotatably driving said flux guide as a whole about said axis of rotation.

3. An apparatus as claimed in claim 2, wherein said axis of rotation forms an angle ($\alpha$) between 30° and 150° with said rolling plane.

4. An apparatus as claimed in claim 1, wherein said flux guide is bent.

5. An apparatus as claimed in claim 1, wherein said flux guide comprises at least one deflection fin which is mounted movable inside the flux guide so as to extend:

in a first orientation corresponding to a first direction, called a nominal direction, of the flux originating from said propulsion outlet for a first flow value, called a nominal flow, of the flux emitted by the motorized pumping device, in at least a second orientation corresponding to a second direction, different from the nominal direction, of the flux originating from said propulsion outlet for at least a second flow value of the flux different from said nominal flow emitted by the motorized pumping device.

6. An apparatus as claimed in claim 1, wherein said actuator is configured for orientating and retaining at least one said deflection member of the flux guide in at least three different positions corresponding to three different horizontal components having different orientations.

7. An apparatus as claimed in claim 6, wherein said actuator is configured for orientating and retaining said deflection member of said flux guide in any position so that said corresponding horizontal component can have any orientation.

8. An apparatus as claimed in claim 1, wherein said propulsion outlet on which the flux guide is mounted is offset backwards in a longitudinal orientation of each liquid inlet with which it is in communication via a hydraulic circuit and wherein said flux guide protrudes relative to the upper walls of the apparatus opposite said rolling plane so that said current of liquid which is discharged from the flux guide can disperse freely without encountering other parts of the apparatus.

9. An apparatus as claimed in claim 1, wherein said control unit can be programmed so as to allow parameterizing of a control of said actuator, said parameterizing being specific to each surface to be cleaned by the apparatus.

10. An apparatus as claimed in claim 1, wherein said flux guide has a shape configured so that said current of liquid which is discharged from the apparatus via said propulsion outlet can further create, by means of reaction, a hydraulic reaction force which has a non-zero vertical component of the apparatus in a downward direction.

11. An apparatus as claimed in claim 1, wherein it comprises at least one electric drive motor of at least one rolling member, called a drive rolling member, so as to form an additional drive device which is capable of moving, via said at least one drive rolling member, said hollow body over the immersed surface.

12. An apparatus as claimed in claim 11, wherein it comprises a front axle which carries at least one drive rolling member which is mounted relative to said body so as to rotate about a transverse axis.

13. An apparatus as claimed in claim 12, wherein said front axle carries two drive rolling members mounted at one end of said front axle, another one mounted at another end of said front axle, each drive rolling member being rotatably driven by an electric drive motor.

14. An apparatus as claimed in claim 11, wherein each electric motor is supplied via a battery on-board the apparatus.

15. An apparatus as claimed in claim 1, wherein said pumping device comprises an electric pumping motor comprising a rotating drive shaft connected to an axial pumping propeller interposed in a hydraulic circuit and whose axis of rotation is inclined relative to said longitudinal orientation and is different from said axis of rotation of said flux guide.

16. An apparatus as claimed in claim 1, wherein the body is hollow and the at least one liquid inlet is located at a base of the body.

17. A swimming pool cleaner comprising:

a. a body (i) configured in use for movement along a generally horizontal surface within a swimming pool and (ii) comprising a water inlet and a water outlet;

b. means, directly or indirectly connected to the body, for contacting the generally horizontal surface so as to facilitate movement of the body in use;

c. a motorized pumping device (i) having at least a portion contained within the body and (ii) configured in use to move water toward the water outlet;

d. a flux guide (i) in liquid communication with the water outlet and (ii) comprising a moveable deflection member;

e. an electronic control unit; and f. an actuator (i) controlled in use by the electronic control unit and (ii) configured in use to orient the moveable deflection member in at least first and second positions, orientation in the first position producing a first drive force having a generally horizontal component, orientation in the second position producing a second drive force having a generally horizontal component, the generally horizontal component of the first drive force driving the body in a first direction along the generally horizontal surface, the generally horizontal component of the second drive force driving the body in a second direction along the generally horizontal surface, and the second direction being different than the first direction and not opposite the first direction.

18. A swimming pool cleaner according to claim 17 in which the electronic control unit comprises a memory containing prerecorded control programs.

19. A swimming pool cleaner according to claim 17 in which the electronic control unit is configured to receive signals from an external transmitter.

20. A swimming pool cleaner according to claim 17 in which the flux guide is rotatably mounted on the water outlet.

21. A swimming pool cleaner according to claim 17 in which the contacting means comprises a plurality of wheels.

* * * * *